US006742196B2

(12) United States Patent
LaHay

(10) Patent No.: US 6,742,196 B2
(45) Date of Patent: Jun. 1, 2004

(54) SPA COVER REMOVER

(75) Inventor: Leon LaHay, Langley (CA)

(73) Assignee: ABC SPA Cover Removal Co. Ltd., Langley (CA)

( * ) Notice: Subject to any disclaimer, the term of this patent is extended or adjusted under 35 U.S.C. 154(b) by 0 days.

(21) Appl. No.: 10/093,064

(22) Filed: Mar. 8, 2002

(65) Prior Publication Data

US 2003/0167564 A1 Sep. 11, 2003

(51) Int. Cl.[7] ..... E04H 4/00

(52) U.S. Cl. ..... 4/498; 4/580; 4/245.3; 4/246.3; 160/77; 160/79

(58) Field of Search ..... 4/580, 498, 245.3, 4/246.3; 160/77, 79, 80, 82, 83.1; 403/109.1, 172

(56) References Cited

U.S. PATENT DOCUMENTS 3,958,889 A * 5/1976 Berkowitz ..... 403/172
4,853,985 A * 8/1989 Perry ..... 4/498
4,991,238 A * 2/1991 Forrest ..... 4/498
5,048,153 A * 9/1991 Wall et al. ..... 16/223
5,131,102 A * 7/1992 Salley et al. ..... 4/498
5,634,218 A * 6/1997 Ouelette ..... 4/498
6,213,672 B1 * 4/2001 Varga ..... 403/109.2

* cited by examiner

*Primary Examiner*—Henry Bennett
*Assistant Examiner*—Azy Kokabi

(57) ABSTRACT

A spa cover remover has a spa cover support including a pair of parallel side bars at opposite respective sides of a spa, the side bars having upper and lower ends, with a crossbar extending between the upper ends of the side bars, a pivot shaft extending between the lower ends of the side bars and rigid connections between the lower end of the side bars and the pivot shaft and between the upper ends of the side bars and the crossbar. The spa cover support is pivotable about the longitudinal axis of the pivot shaft and a resilient connection between the spa cover support and the spa allows pivotation of the spa cover support about that axis to locate the crossbar, with a spa cover folded over the crossbar, in a supporting position offset from above the spa. The crossbar, the pivot shaft and the side arms are each made of telescopically interengaged and adjustable sections to enable the spa cover remover to be adapted to spas of different sizes.

6 Claims, 9 Drawing Sheets

SPA COVER REMOVER

BACKGROUND OF THE INVENTION

1. Field of the Invention

The present invention relates to spa cover removers and, more particularly, to spa cover removers having a pair of parallel side arms which are pivotable at opposite respective sides of a spa, about the lower ends of the side arms, and a crossbar extending between the upper ends of the side arms.

2. Description of the Related Art

In my U.S. Pat. No. 6,000,072, issued Dec. 14, 1999, I have disclosed a spa cover remover having a pair of parallel side bars pivotally connected at their lower ends to opposite sides of a spa, with a crossbar in the form of a roller extending between upper ends of the side bars.

I have now found, from experience with the use of such a spa cover remover, that it is desirable to maintain the side arms rigidly parallel to one another, in order to avoid bending and bowing of the crossbar.

BRIEF SUMMARY OF THE INVENTION

According to the present invention, therefore, I provide a spa cover remover comprising a spa cover support for raising a spa cover, the spa cover support including a pair of parallel side bars at opposite respective sides of a spa, the side bars having upper and lower ends, with a crossbar extending between the upper ends of the side bars, a pivot shaft extending between the lower ends of the side bars and rigid connections between the lower end of the side bars and the pivot shaft and between the upper ends of the side bars and the crossbar. The spa cover support is pivotable about the longitudinal axis of the pivot shaft. The crossbar is formed of inner and outer telescopically interengaged and adjustable sections, so that the spa cover remover is readily adaptable to spa housings of various dimensions, and the outer sections have recesses accommodating the heads of screws securing the sections together, whereby damage to the spa cover is avoided.

Preferably, a resilient connection between the spa cover support and the spa allows pivotation of the spa cover support about that axis to locate the crossbar, with a spa cover folded over the crossbar, in a supporting position offset from above the spa.

By rigidly reconnecting together the sidebars, the pivot shaft and the crossbar, the spa cover remover can be pivoted to and fro, to move the spa cover to and from the spa, by applying force to only one of the sidebars, without causing the spa cover remover to become twisted.

BRIEF DESCRIPTION OF THE DRAWINGS

The present invention will be more readily understood from the following description of a preferred embodiment thereof given, by way of example, with reference to the accompanying drawings, in which.

DESCRIPTION OF THE PREFERRED EMBODIMENT

Figure 1:
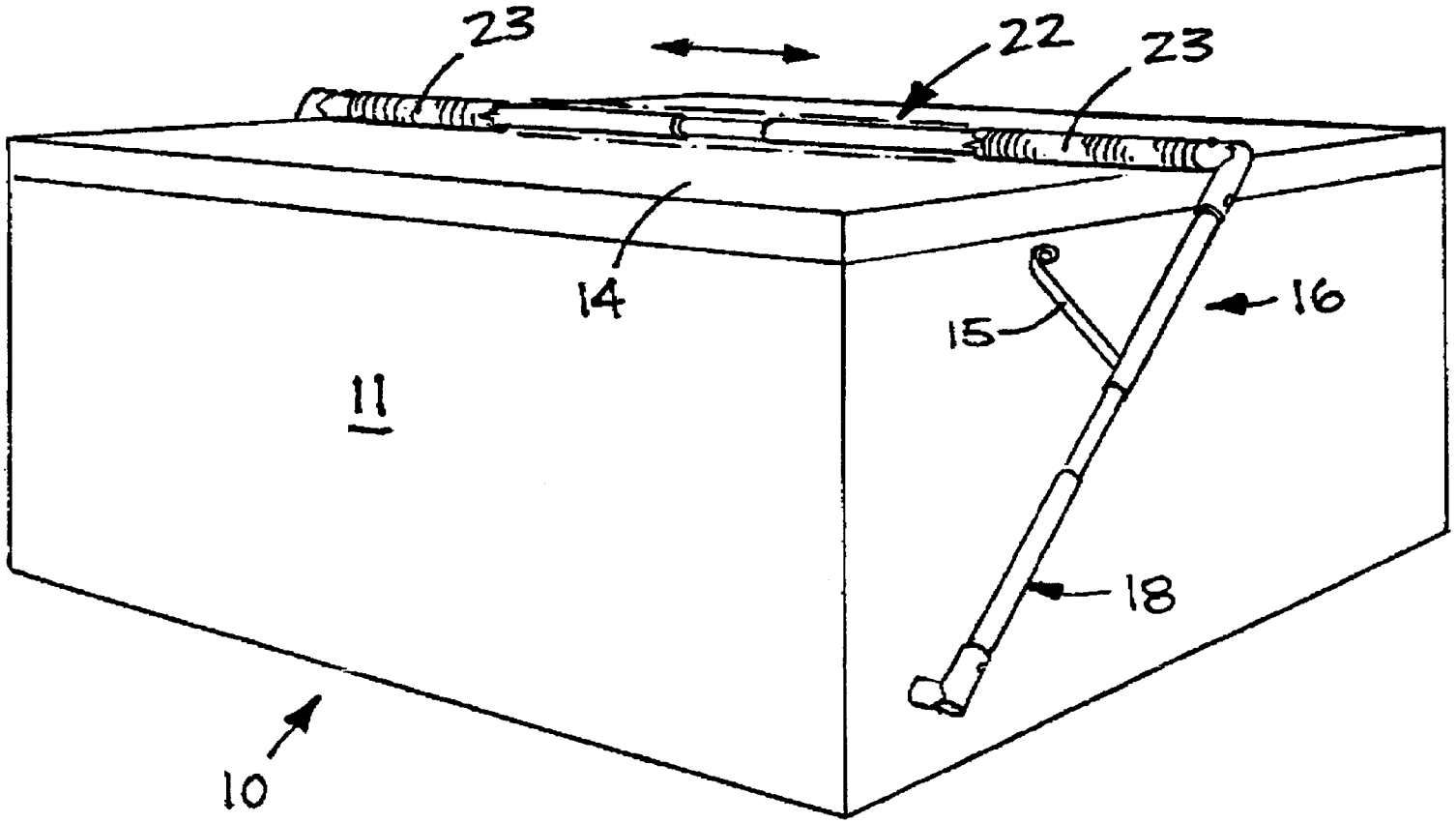
FIG. 1 shows a view in perspective of a spa provided with a spa cover remover according to the preferred embodiment of the present invention.

FIG. 1 shows a view in perspective of a spa indicated generally by reference numeral 10, which has a spa housing 11, a spa cover 14 and a spa cover remover indicated generally by reference numeral 16.

Figure 8:
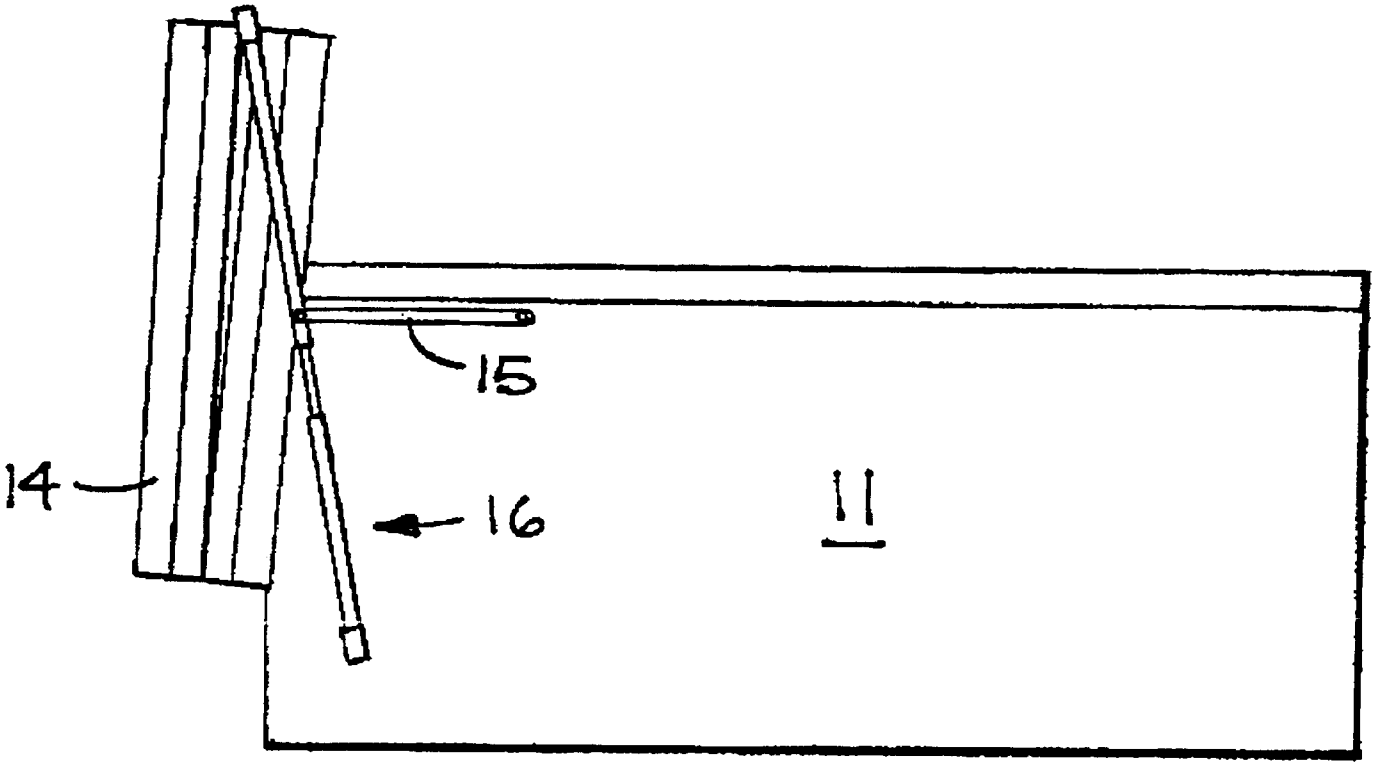
FIG. 8 shows a view in side elevation of the spa and spa cover remover of FIG. 1, with a spa cover removed from the spa.

The spa cover remover 16 has a pair of side arms 18, which have lower ends connected by a pivot shaft 20 extending through the spa housing 11 and upper ends connected by a crossbar 22. The crossbar 22 has a cover formed by a plastic tube 23 which is freely rotatable about the crossbar 22. The pivot shaft 20 is mounted in the spa housing 11, in a manner described in greater detail below, so as to be pivotable about the longitudinal axis of the pivot shaft 20. Thus, the entire spa cover remover 16 is pivotable about this longitudinal axis. The amount of this pivotation is determined by a resilient connection in the form of a spring comprising a length of elastomeric material forming a tie 15 connected between each side arm 18 and the respective side of the spa housing 11. The lengths of the ties 15 are such that when the spa cover 14 is folded over the crossbar 22 and the spa cover remover 16 is pivoted, to offset the crossbar 22 from over the spa housing 11 and into a supporting position, by an amount determined by the tie 15, the folded spa cover 14 is located approximately in the supporting position in which it is shown in FIG. 8 and in which the spa cover is supported above ground level. The resilience of the tie 15 has the advantage that if a user of the spa sits on the portion of the spa cover 14 at which the crossbar 22 is located, the tie 15 can thereby be stretched further so as to avoid damage to the spa cover remover 16 by the weight of the sitter.

Also, the tension in the tie 15 resiliently biases the spa cover remover 16 for pivotation in a clockwise direction, as shown in FIG. 8, which facilitates the closing of the spa cover 14 onto the top of the spa.

Because the tie 15 is stretchable, it cushions and reduces the pressure exerted by the crossbar 22 on the seams of the spa cover 14, in comparison with the pressure which would occur if the tie 15 were not stretchable, if the spa cover remover 16 and the spa cover 14 are, inadvertently, released and dropped while being moved towards the supporting position shown in FIG. 8.

Figure 2:
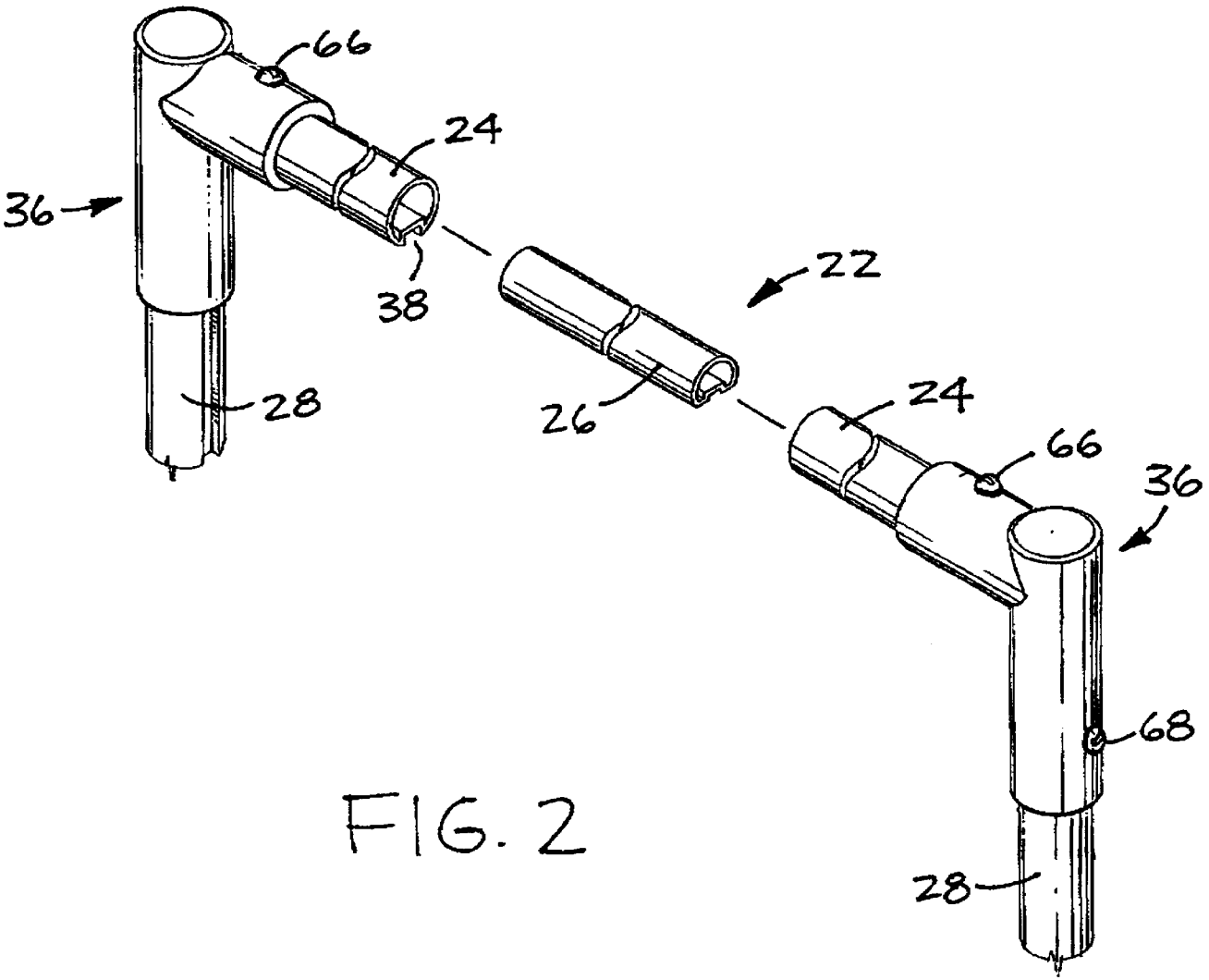
FIG. 2 shows a broken-away view, in perspective, of parts of the spa cover remover of FIG. 1.
Figure 9:
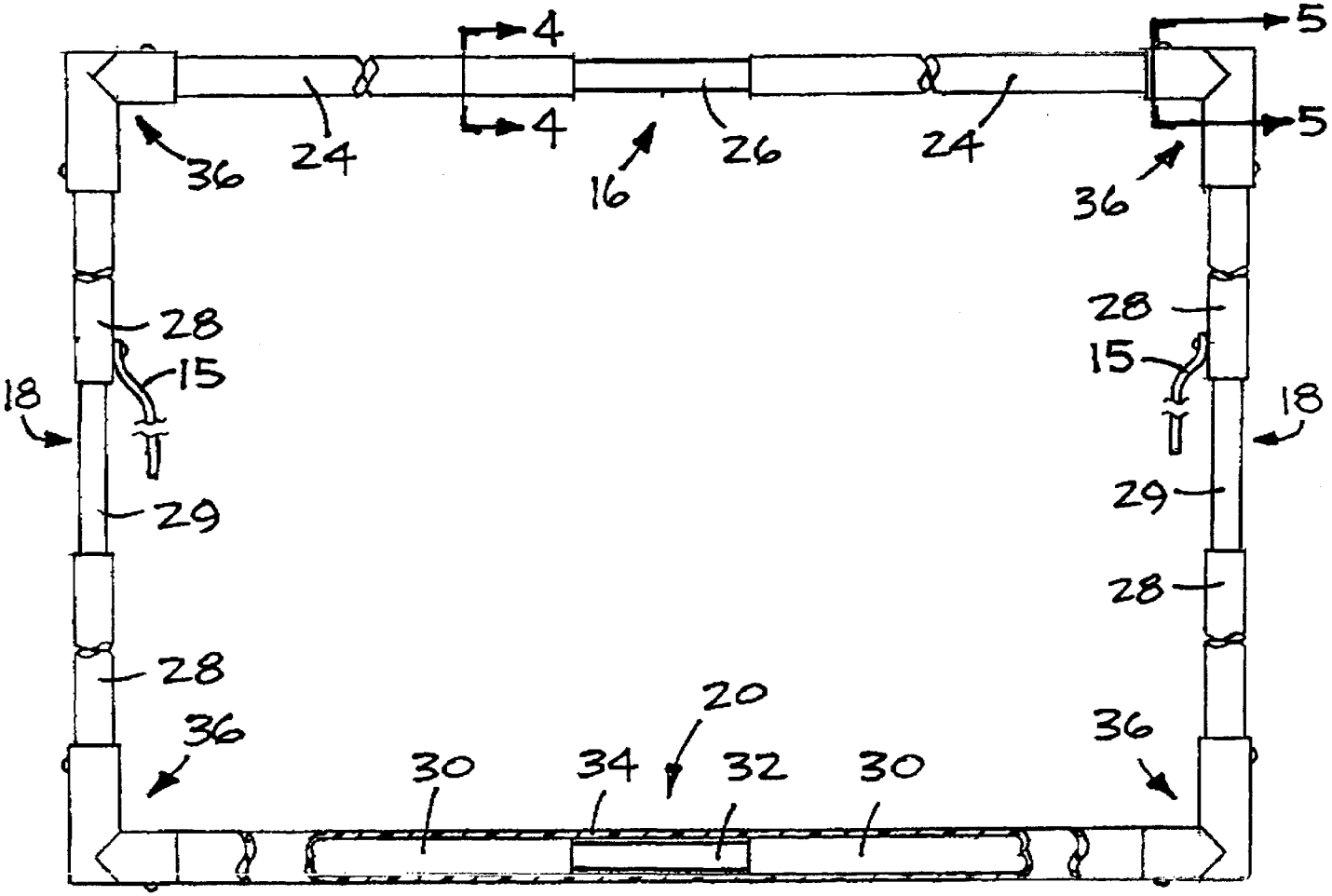
FIG. 9 shows a plan view, partly broken away in section, of the spa cover remover of FIG. 1.
Figure 10:
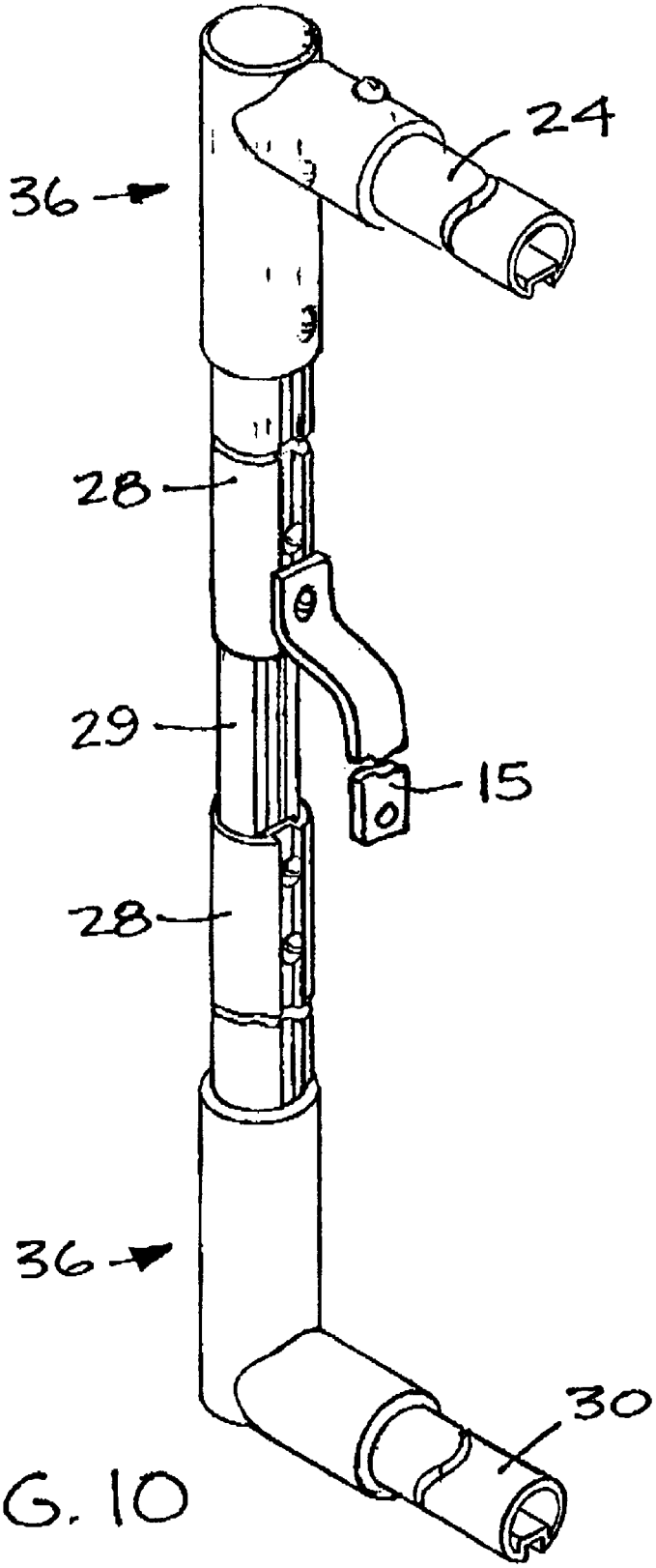
FIG. 10 shows a broken-away in view, in perspective, of parts of the spa cover remover of FIG. 1.

As can be seen, in particular, from FIGS. 2 and 9, the crossbar 22 is made of a pair of outer sections 24 and an inner section 26 which is telescopically interengaged with the outer sections 24 and, thus, telescopically adjustable relative to the outer sections 24.

Likewise, the side arms 18 each comprise a pair of outer sections 28 and an inner section 30 which is telescopically engaged with, and thus telescopically adjustable relative to, the outer sections 28.

Also, the pivot shaft 20 has a pair of outer sections 30 and an inner section 32 which is telescopically interengaged with and, thus, telescopically adjustable relative to, the outer sections 30. The spa cover remover 16 is therefore adjustable in size to adapt to spa housings of different sizes.

The pivot shaft 20 is enclosed in a plastic tube 34, and the crossbar 22 is enclosed in a plastic tube (not shown) 35, which acts as a roller.

As can be seen from FIG. 9, the side arms 18, the crossbar 22 and the pivot shaft 20 are connected together by elbow connectors, indicated generally by reference numeral 36, to form a rectangular assembly.

Figure 3:
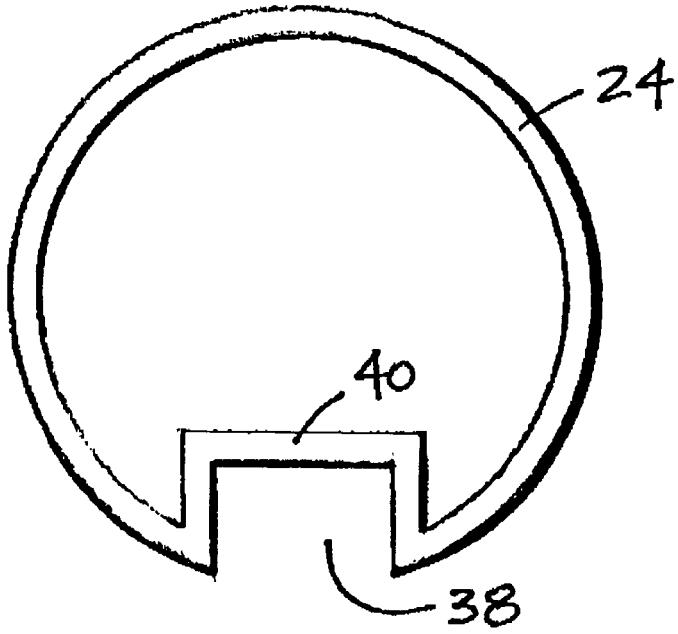
FIG. 3 shows a view taken in end elevation of a part of a crossbar of the spa cover remover of FIG. 2.

FIG. 3 shows a view in end elevation of one of the outer sections 24 of the crossbar 22, and it is to be understood that it the outer sections 30 of the pivot shaft 20 and the outer sections 28 of the side arms 18 are of a cross-section similar to that of the outer sections 24, which is shown in FIG. 3.

More particularly, the shape of the outer section 24 shown in FIG. 3 is that of a tube of circular cross-section interrupted by an external recess, indicated by reference numeral 38, of rectangular cross-section, which extends longitudinally of the outer section 24. The recess 38 provides an inner, flat, longitudinally extending inner surface 40 in the interior of the outer section 24.

Figure 4:
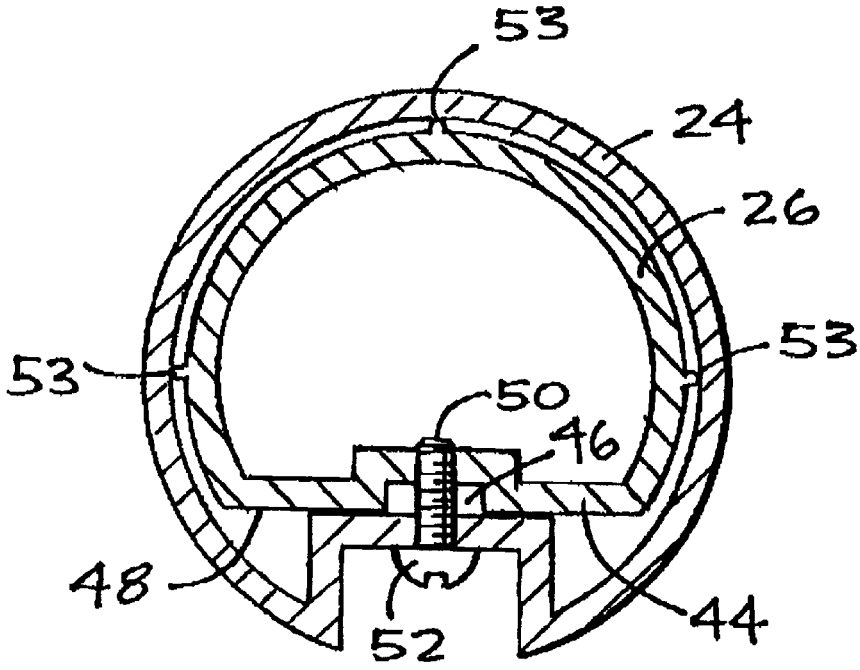
FIG. 4 shows a view taken in transverse cross-section along the line of 4—4 of FIG. 9.

The cross-sectional shape of the inner section 26, which in FIG. 4 is shown within that of the outer section 24, comprises a circular section 42 interrupted by a flat section 44, which in turn is interrupted by a recess 46. The flat section 44 presents an outer flat surface 48 in contact with the flat inner surface 40 of the outer section 24.

The inner and outer sections 26 and 24 are secured against relative longitudinal displacement by a self-tapping securing screw 50, which is in threaded engagement with the inner and outer sections 26 and 24. The screw 50 has a screw head 52 which is entirely accommodated within the recess 38 in the outer section 24, so that this screw head 52 does not interfere with free rotation of the sleeve about the inner and outer sections 26 and 24.

The inner section 26 is formed with small projections, in the form of longitudinal ribs 53, on its exterior, and these ribs 53 facilitate relative longitudinal or telescopic sliding of the inner and outer sections 26 and 24 relative to one another without excessive fiction, which might otherwise occur since the inner and outer sections 26 and 24 are made of aluminum.

Figure 5:
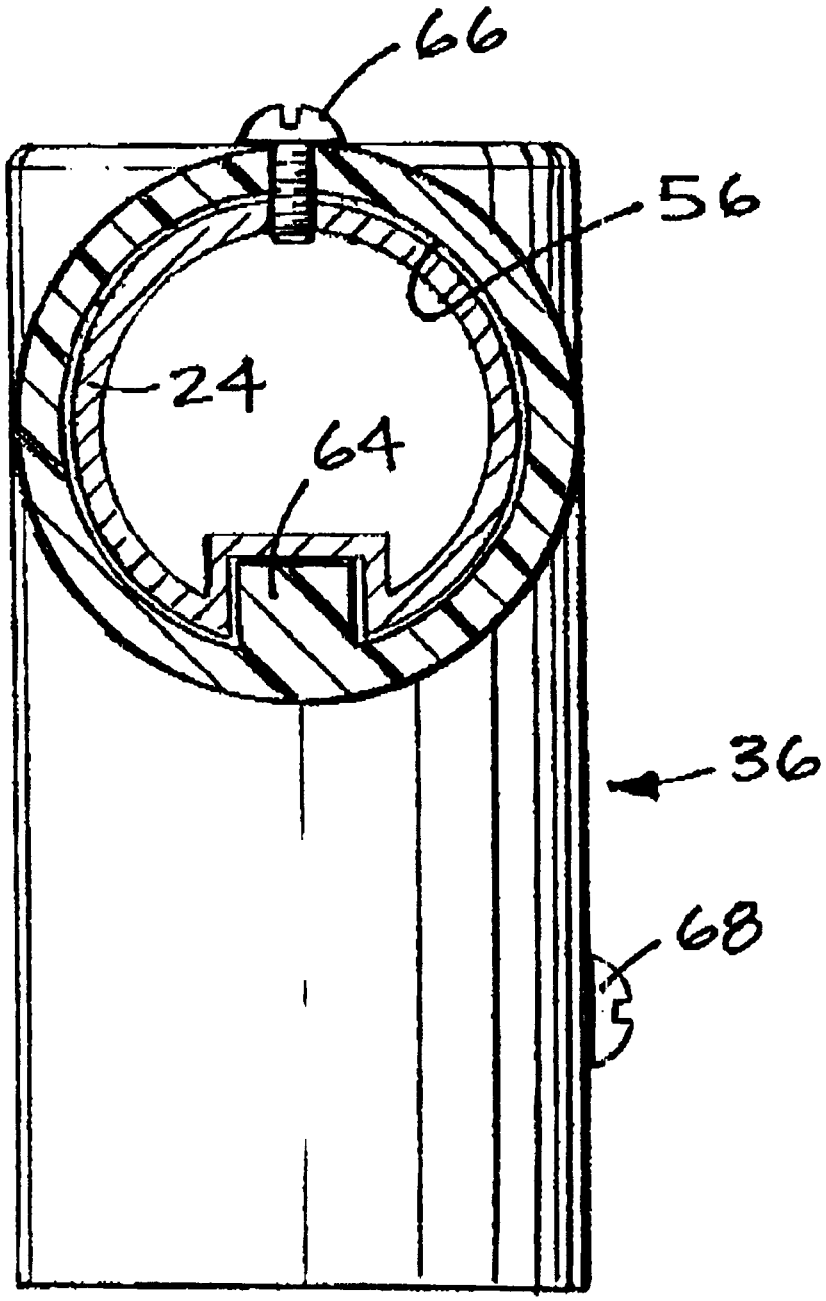
FIG. 5 shows a view taken in transverse cross-section along the line 5—5 of FIG. 9 through an elbow connector.
Figure 6:
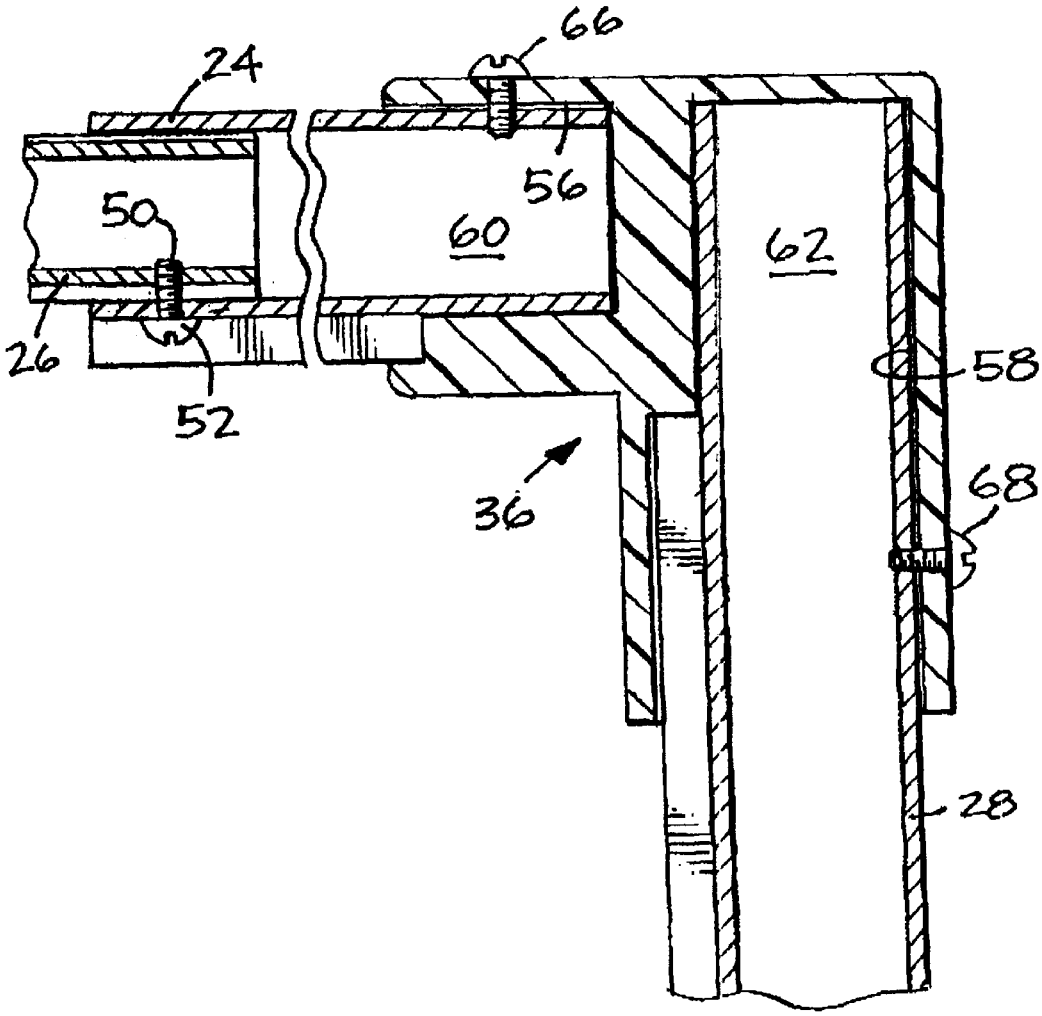
FIG. 6 is a broken-away view taken in longitudinal cross-section through the elbow connector of FIG. 5.

Referring now to FIGS. 5 and 6, which illustrate one of the elbow connectors 36, in engagement with one of the outer sections 24 of the crossbar 22 and, in FIG. 6, with one of the outer sections 28 of one of the sidebars 18, it can be seen that the elbow connector 36 has cylindrical openings 56 and 58, respectively, receiving end portions 60 and 62 of the outer sections 24 and 28. The elbow connector 36 also has an internal projection 64, which extends into the recess 38 in the end section 60, so as to retain the outer section 28 against rotation. The end portions 60 and 62 are secured in the elbow connector 36 by self-tapping securement screws 66 and 68 in threaded engagement with the end portions 60 and 62.

The elbow connectors 36 interconnecting the sidebars 18 and the pivot shaft 20 are identical to the elbow connector 36 illustrated in FIGS. 5 and 6 and, therefore, will not be further described.

The above-described connections of the crossbar 22 and the pivot shaft 20 to the sidebars 18 by the elbow connectors 36 forms the assembly of these components, shown in FIG. 9, into a rigid rectangular frame. Consequently, as the spa cover remover 16 is pivoted to and fro about the axis of the pivot shaft 32, the crossbar 22 and the pivot shaft 20 remain relatively parallel to one another, and the sidebars 18 likewise remain relatively parallel to one another, even while the weight of the spa cover 14 is carried by the crossbar 22. It is therefore feasible for the user to effect such pivotation by holding and displacing one of the sidebars 18.

This represents a substantial improvement over prior art spa cover removers with sidebars which were not rigidly connected to one another at their lower ends nor to their crossbar Consequently, moving the prior art spa cover remover by one of the sidebars would cause the spa cover remover to twist before taking up rotational slack to move the other side bar. The prior spa cover remover, therefore, had to be operated from the middle of the spa cover to avoid such twisting of the spa cover remover.

Also, the provision of the elbow connectors 36 makes it possible to insert the pivot shaft 20 through the tube 34, which is easily secured to the spa housing 11 by the manufacturer of the spa.

Figure 7:
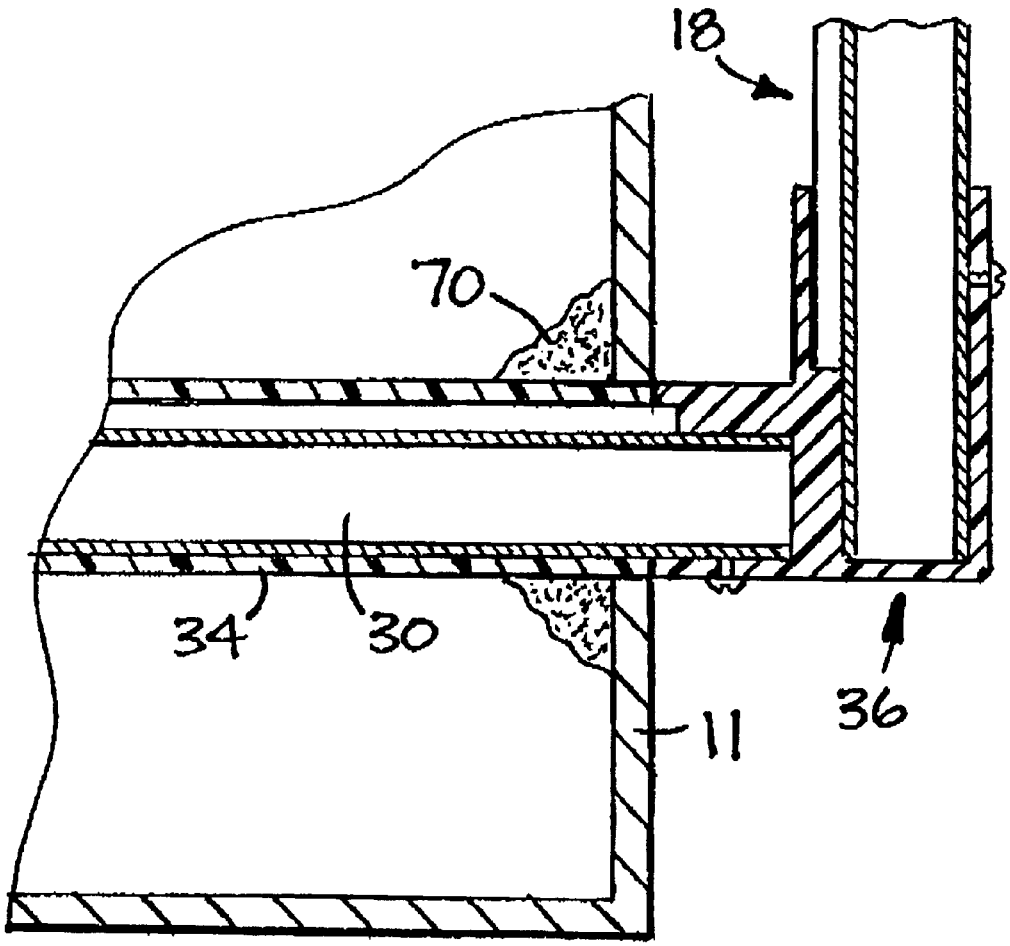
FIG. 7 shows a broken-only view, taken in cross-section, through parts of a pivot shaft and a lower end of one of the side arms of the spa cover remover of FIG. 1.

Opposite ends of the plastic tube 34 of the pivot shaft 20 extend through and are secured to the spa housing 11 in a simple matter by means of a foam plastic 70, as shown in FIG. 7, which adheres to the inner surface of the spa housing 11 and to the plastic tube 34.

As will be apparent to those skills in the art, various modifications may be made to the above-described spa cover remover within the scope of the appended claims.

I claim:

1. A spa cover remover, comprising:

a spa cover support for raising a spa cover;

the spa cover support including a pair of parallel side bars at opposite respective sides of a spa;

the side bars having upper and lower ends;

a crossbar extending between the upper ends of the side bars;

a pivot shaft extending between the lower ends of the side bars; and rigid connections between the lower end of the side bars and the pivot shaft and between the upper ends of the side bars and the crossbar;

the spa cover support being pivotable about the longitudinal axis of the pivot shaft;

the side arms, the crossbar and the pivot shaft each comprising telescopically interengaged and adjustable sections;

the telescopically interengaged and adjustable sections comprising inner and outer telescopically interengaged sections;

the outer telescopically interengaged sections each having an external recess; and screws interconnecting the inner and outer telescopically interengaged sections, the screws having heads entirely received within the recesses.

2. A spa cover remover as claimed in claim 1, including elbow connectors rigidly interconnecting the side bars and the crossbar, the elbow connectors having internal projections engaging in the recesses to prevent rotation of the crossbar relative to the elbow connectors.

3. A spa cover remover as claimed in claim 1, wherein the inner telescopically interengaged section has external projections to facilitate relative telescopic sliding of the inner and outer telescopically interengaged sections.

4. A spa cover remover, comprising:

a spa cover support for raising a spa cover;

the spa cover support including a pair of parallel side bars at opposite respective sides of a spa;

the side bars having tipper and lower ends;

a crossbar extending between the upper ends of the side bars;

a pivot shaft extending between the lower ends of the side bars; and rigid connections between the lower end of the side bars and the pivot shaft and between the upper ends of the side bars and the crossbar;

the spa cover support being pivotable about the longitudinal axis of the pivot shaft;

the side arms, the crossbar and the pivot shaft each comprising telescopically interengaged and adjustable sections;

the telescopically interengaged and adjustable sections comprising inner and outer telescopically interengaged sections;

the outer telescopically interengaged sections each having an external recess;

screws interconnecting the inner and outer telescopically interengaged sections, the screws having heads entirely received within the recesses; and the inner and outer telescopically interengaged sections having longitudinally extending flat surfaces in contact with one another to prevent relative rotation of the inner and outer telescopically interengaged sections.

5. A spa cover remover as claimed in claim 4, including elbow connectors rigidly interconnecting the side bars and the crossbar, the elbow connectors having internal projections engaging in the recesses to prevent rotation of the crossbar relative to the elbow connectors.

6. A spa cover remover as claimed in claim 4, wherein the inner telescopically interengaged section has external projections to facilitate relative telescopic sliding of the inner and outer telescopically interengaged sections.

* * * * *